US006851796B2

(12) United States Patent
Jeanmaire et al.

(10) Patent No.: US 6,851,796 B2
(45) Date of Patent: Feb. 8, 2005

(54) CONTINUOUS INK-JET PRINTING APPARATUS HAVING AN IMPROVED DROPLET DEFLECTOR AND CATCHER

(75) Inventors: David L. Jeanmaire, Brockport, NY (US); Gilbert A. Hawkins, Mendon, NY (US); Charles F. Faisst, Jr., Avon, NY (US); Gregory J. Garbacz, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 147 days.

(21) Appl. No.: 09/999,356

(22) Filed: Oct. 31, 2001

(65) Prior Publication Data

US 2003/0081082 A1 May 1, 2003

(51) Int. Cl.[7] ..... B41J 2/07; B41J 2/185

(52) U.S. Cl. ..... 347/74; 347/90

(58) Field of Search ..... 347/74, 75, 77, 347/78, 82, 90, 73, 80, 79, 76, 34

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,709,432 A | | 1/1973 | Robertson | |
| 3,878,519 A | | 4/1975 | Eaton | |
| 4,068,241 A | | 1/1978 | Yamada | 397/75 |
| 4,190,844 A | | 2/1980 | Taylor | |
| 4,346,387 A | | 8/1982 | Hertz | |
| 4,638,328 A | | 1/1987 | Drake et al. | |
| 5,812,167 A | * | 9/1998 | Braun | 347/90 |
| 6,079,821 A | | 6/2000 | Chwalek et al. | |
| 6,203,150 B1 | | 3/2001 | Zaba et al. | 347/90 |
| 6,254,225 B1 | | 7/2001 | Chwalek et al. | 347/82 |
| 6,517,197 B2 | * | 2/2003 | Hawkins et al. | 347/74 |
| 6,554,410 B2 | * | 4/2003 | Jeanmaire et al. | 347/77 |
| 6,575,566 B1 | * | 6/2003 | Jeanmaire et al. | 347/77 |

* cited by examiner

*Primary Examiner*—K. Feggins
(74) *Attorney, Agent, or Firm*—William R. Zimmerli

(57) ABSTRACT

An apparatus for printing an image is provided. The apparatus includes an ink droplet forming mechanism operable to selectively create a stream of ink droplets having a plurality of volumes traveling along a first path. A droplet deflector is positioned at an angle with respect to the stream of ink droplets. The droplet deflector includes a gas flow operable to interact with the stream of ink droplets such that ink droplets having one of the plurality of volumes begin traveling along a second path and ink droplets having another of the plurality of volumes begin traveling along a third path. At least a portion of a catcher including a porous material is at least partially positioned in one of the first, second, and third paths.

23 Claims, 4 Drawing Sheets

CONTINUOUS INK-JET PRINTING APPARATUS HAVING AN IMPROVED DROPLET DEFLECTOR AND CATCHER

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled printing capability is accomplished by one of two technologies. The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the inkjet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink droplets. Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

U.S. Pat. No. 1,941,001, issued to Hansell, on Dec. 26, 1933, and U.S. Pat. No. 3,373,437 issued to Sweet et al., on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,878,519, issued to Eaton, on Apr. 15, 1975, discloses a method and apparatus for synchronizing droplet formation in a liquid stream using electrostatic deflection by a charging tunnel and deflection plates.

U.S. Pat. No. 4,346,387, issued to Hertz, on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat No. 4,638,328, issued to Drake et al., on Jan. 20, 1987, discloses a continuous inkjet printhead that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control.

U.S. Pat. No. 3,709,432, issued to Robertson, on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets it does rely on the precise control of the break off points of the filaments and the placement of the air flow intermediate to these break off points. Such a system is difficult to control and to manufacture. Furthermore, the physical separation or amount of discrimination between the two droplet paths is small further adding to the difficulty of control and manufacture.

U.S. Pat. No. 4,190,844, issued to Taylor, on Feb. 26, 1980, discloses a continuous ink jet printer having a first pneumatic deflector for deflecting non-printed ink droplets to a catcher and a second pneumatic deflector for oscillating printed ink droplets. A printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink droplet is to be printed or non-printed. The second pneumatic deflector is a continuous type having a diaphram that varies the amount a nozzle is open depending on a varying electrical signal received the central control unit. This oscillates printed ink droplets so that characters may be printed one character at a time. If only the first pneumatic deflector is used, characters are created one line at a time, being built up by repeated traverses of the printhead.

While this method does not rely on electrostatic means to affect the trajectory of droplets it does rely on the precise control and timing of the first ("open/closed") pneumatic deflector to create printed and non-printed ink droplets. Such a system is difficult to manufacture and accurately control resulting in at least the ink droplet build up discussed above. Furthermore, the physical separation or amount of discrimination between the two droplet paths is erratic due to the precise timing requirements increasing the difficulty of controlling printed and non-printed ink droplets resulting in poor ink droplet trajectory control.

Additionally, using two pneumatic deflectors complicates construction of the printhead and requires more components. The additional components and complicated structure require large spatial volumes between the printhead and the media, increasing the ink droplet trajectory distance. Increasing the distance of the droplet trajectory decreases droplet placement accuracy and affects the print image quality. Again, there is a need to minimize the distance the droplet must travel before striking the print media in order to insure high quality images.

U.S. Pat. No. 6,079,821, issued to Chwalek et al., on Jun. 27, 2000, discloses a continuous ink jet printer that uses actuation of asymmetric heaters to create individual ink droplets from a filament of working fluid and deflect thoses ink droplets. A printhead includes a pressurized ink source and an asymmetric heater operable to form printed ink droplets and non-printed ink droplets. Printed ink droplets flow along a printed ink droplet path ultimately striking a print media, while non-printed ink droplets flow along a non-printed ink droplet path ultimately striking a catcher surface. Non-printed ink droplets are recycled or disposed of through an ink removal channel formed in the catcher. While this device works extremely well for its intended use, the angle of ink drop deflection is relatively small.

SUMMARY OF THE INVENTION

An object of the present invention is to provide an ink jet printhead having improved ink droplet deflection angles and improved non-printed ink droplet removal capabilities.

According to a feature of the present invention, an apparatus for printing an image includes an ink droplet forming mechanism operable to selectively create a stream of ink droplets having a plurality of volumes traveling along a first path. A droplet deflector is positioned at an angle with respect to the stream of ink droplets. The droplet deflector includes a gas flow operable to interact with the stream of ink droplets such that ink droplets having one of the plurality of volumes begin traveling along a second path and ink droplets having another of the plurality of volumes begin traveling along a third path. At least a portion of a catcher having a porous material is at least partially positioned in one of the first, second, and third paths.

According to another feature of the present invention, a method of manufacturing an inkjet printhead includes providing an ink droplet forming mechanism operable to selectively create a stream of ink droplets having a plurality of volumes traveling along a first path; providing a droplet deflector positioned at an angle with respect to the stream of ink droplets, the droplet deflector including a gas flow operable to interact with the stream of ink droplets such that ink droplets having one of the plurality of volumes begin traveling along a second path and ink droplets having another of the plurality of volumes begin traveling along a third path; and providing a catcher, at least a portion of the catcher including a porous material at least partially positioned in one of the first, second, and third paths.

According to another feature of the present invention, an ink jet printer includes a printhead having a nozzle and a heater positioned proximate to the nozzle with portions of the nozzle defining an ink travel path. A droplet deflector having a gas flow is positioned at an angle with respect to the nozzle. A catcher is positioned spaced apart from the printhead and proximate to the ink travel path with at least a portion of the catcher including a porous material.

According to another feature of the present invention, an apparatus for printing an image includes a droplet forming mechanism operable in a first state to form droplets having a first volume travelling along a path and in a second state to form droplets having a second volume travelling along the path. A system applies force to the droplets travelling along the path with the force being applied in a direction such as to separate droplets having the first volume from droplets having the second volume. A portion of the system is made from a porous material positioned to catch one of the droplets having the first volume and the droplets having the second volume.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
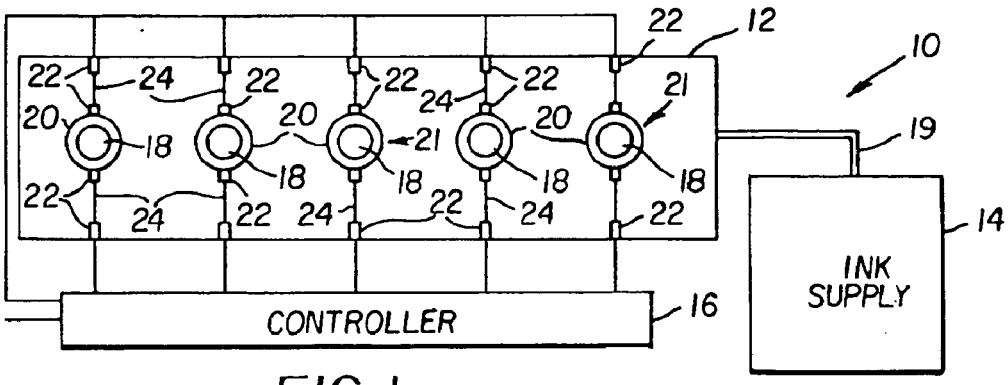
FIG. 1 is a schematic plan view of a printhead made in accordance with a preferred embodiment of the present invention.
Figure 2A:
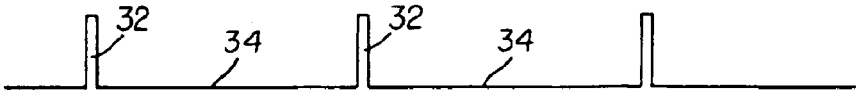
FIGS. 2(*a*)–2(*f*) illustrates a frequency control of a heater used in the preferred embodiment of FIG. 1.
Figure 2B:
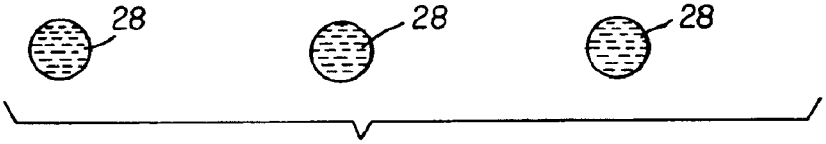
Figure 2C:
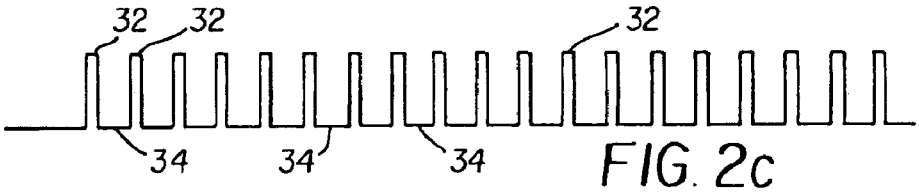
Figure 2D:
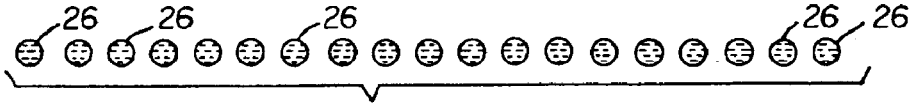
Figure 2E:
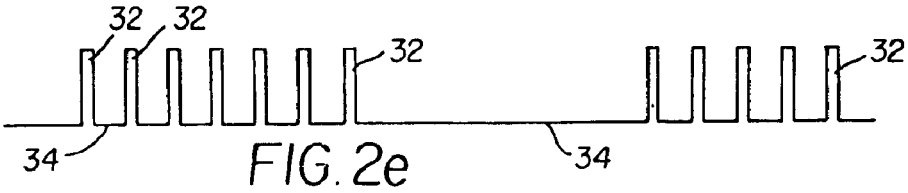
Figure 2F:
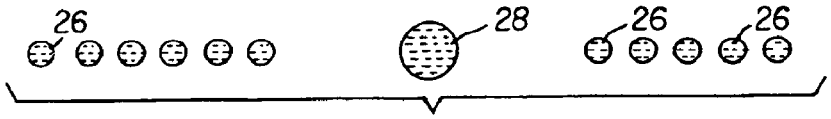

Referring to FIG. 1, a printing apparatus 10 of a preferred embodiment of the present invention is shown. Printing apparatus 10 includes a printhead 12, at least one ink supply 14, and a controller 16. Although printing apparatus 10 is illustrated schematically and not to scale for the sake of clarity, one of ordinary skill in the art will be able to readily determine the specific size and interconnections of the elements of the preferred.

In a preferred embodiment of the present invention, printhead 12 is formed from a semiconductor material (silicon, etc.) using known semiconductor fabrication techniques (CMOS circuit fabrication techniques, micro-electro mechanical structure (MEMS) fabrication techniques, etc.). However, printhead 12 can be formed from any materials using any fabrication techniques conventionally known in the art.

Again referring to FIG. 1, at least one nozzle 18 is formed on printhead 12. Nozzle 18 is in fluid communication with ink supply 14 through an ink passage 19 also formed in printhead 12. Printhead 12 can incorporate additional ink supplies in the manner of 14 with corresponding nozzles 18 in order to provide color printing using multiple ink colors. Additionally, black and white or single color printing may be accomplished using a single ink supply 14 and nozzle 18.

An ink droplet forming mechanism 21 is positioned proximate nozzle 18. In this embodiment, ink droplet forming mechanism 21 is a heater 20. However, ink droplet forming mechanism 21 can also be a piezoelectric actuator, a thermal actuator, etc.

Heater 20 is at least partially formed or positioned on printhead 12 around a corresponding nozzle 18. Although heater 20 may be disposed radially away from an edge of corresponding nozzle 18, heater 20 is preferably disposed close to corresponding nozzle 18 in a concentric manner. In a preferred embodiment, heater 20 is formed in a substantially circular or ring shape. However, heater 20 can be formed in a partial ring, square, etc. Heater 20, in a preferred embodiment, includes an electric resistive heating element electrically connected to electrical contact pads 22 via conductors 24.

Conductors 24 and electrical contact pads 22 may be at least partially formed or positioned on printhead 12 and provide an electrical connection between controller 16 and heater 20. Alternatively, the electrical connection between controller 16 and heater 20 may be accomplished in any well known manner. Additionally, controller 16 may be a relatively simple device (a power supply for heater 20, etc.) or a relatively complex device (logic controller, programmable microprocessor, etc.) operable to control many components (heater 20, ink droplet forming mechanism 10, etc.) in a desired manner.

Referring to FIG. 2, examples of the electrical activation waveforms provided by controller 16 to heater 20 are shown. Generally, a high frequency of activation of heater 20 results in small volume droplets 26, while a low frequency of activation of heater 20 results in large volume droplets 28. Depending on the application, either large volume droplets 28 or small volume droplets 26 can be used for printing while small volume droplets 26 or large volume droplets 28 are captured for ink recycling or disposal.

The electrical waveform of heater 20 actuation for one printing case is presented schematically in FIG. 2(*a*). The individual large volume droplets 28 resulting from the jetting of ink from nozzle 18, in combination with this heater actuation, are shown schematically in FIG. 2(*b*). Heater 20 activation pulse 32 is typically 0.1 to 5 microseconds in duration, and in this example is 1.0 microsecond. The delay time 34 between heater 20 actuations is 42 microseconds. The electrical waveform of heater 20 activation for one non-printing case is given schematically as FIG. 2(*c*). Activation pulse 32 is 1.0 microsecond in duration, and the delay time 36 between activation pulses is 6.0 microseconds. The small volume droplets 26, as diagrammed in FIG. 2(*d*), are the result of the activation of heater 20 with this non-printing waveform.

FIG. 2(*e*) is a schematic representation of the electrical waveform of heater 20 activation for mixed image data where a transition is shown from a non-printing state, to a printing state, and back to a non-printing state. FIG. 2(*f*) is the resultant droplet stream formed. It is apparent that heater 20 activation may be controlled independently based on the ink color required and ejected through corresponding nozzle 18, movement of printhead 12 relative to a print media W, and an image to be printed. Additionally, the volume of the small volume droplets 26 and the large volume droplets 28 can be adjusted based upon specific printing requirements such as ink and media type or image format and size.

Figure 3:
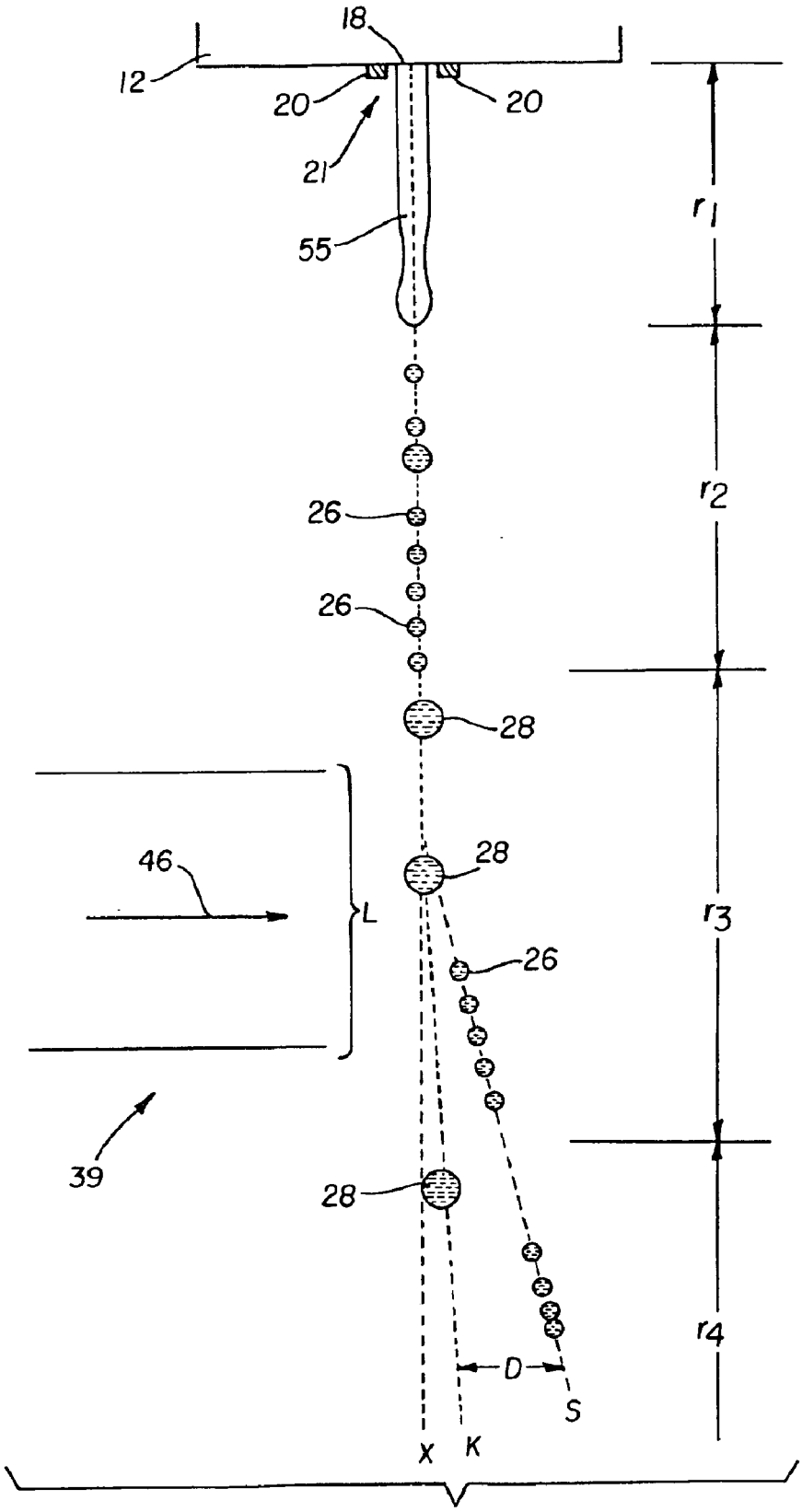
FIG. 3 is a cross-sectional view of an inkjet printhead made in accordance with the preferred embodiment of the present invention.

Referring to FIG. 3, the operation of printhead 12 in a manner such as to provide an image-wise modulation of drop volumes, as described above, is coupled with a system 39 which separates droplets into printing or non-printing paths according to drop volume. Ink is ejected through nozzle 18 in printhead 12, creating a filament of working fluid 55 moving substantially perpendicular to printhead 12 along axis X. The physical region over which the filament of working fluid 55 is intact is designated as $r_1$. Heater 20 (ink droplet forming mechanism 21) is selectively activated at various frequencies according to image data, causing filament of working fluid 55 to break up into a stream of individual ink droplets 26, 28. Some coalescence of drops often occurs in forming large droplets 28. This region of jet break-up and drop coalescence is designated as $r_2$. Following region $r_2$, drop formation is complete in region $r_3$, such that at the distance from the printhead 12 that the system 39 is applied, droplets 26, 28 are substantially in two size classes: small drops 26 and large drops 28. In the preferred implementation, the system includes a force 46 provided by a gas flow substantially perpendicular to axis X. The force 46 acts over distance L, which is less than or equal to distance $r_3$. Large drops 28 have a greater mass and more momentum than small volume drops 26. As gas force 46 interacts with the stream of ink droplets, the individual ink droplets separate depending on each droplets volume and mass. Accordingly, the gas flow rate can be adjusted to sufficient differentiation D in the small droplet path S from the large droplet path K, permitting large drops 28 to strike print media W while small drops 26 are captured by an ink catcher structure described below. Alternatively, small drops 26 can be permitted to strike print media W while large drops 28 are collected by slightly changing the position of the ink catcher.

An amount of separation D between the large drops 28 and the small drops 26 will not only depend on their relative size but also the velocity, density, and viscosity of the gas flow producing force 46; the velocity and density of the large drops 28 and small drops 23; and the interaction distance (shown as L in FIG. 3) over which the large drops 28 and the small drops 26 interact with the gas flow 46. Gases, including air, nitrogen, etc., having different densities and viscosities can also be used with similar results.

Figure 4:
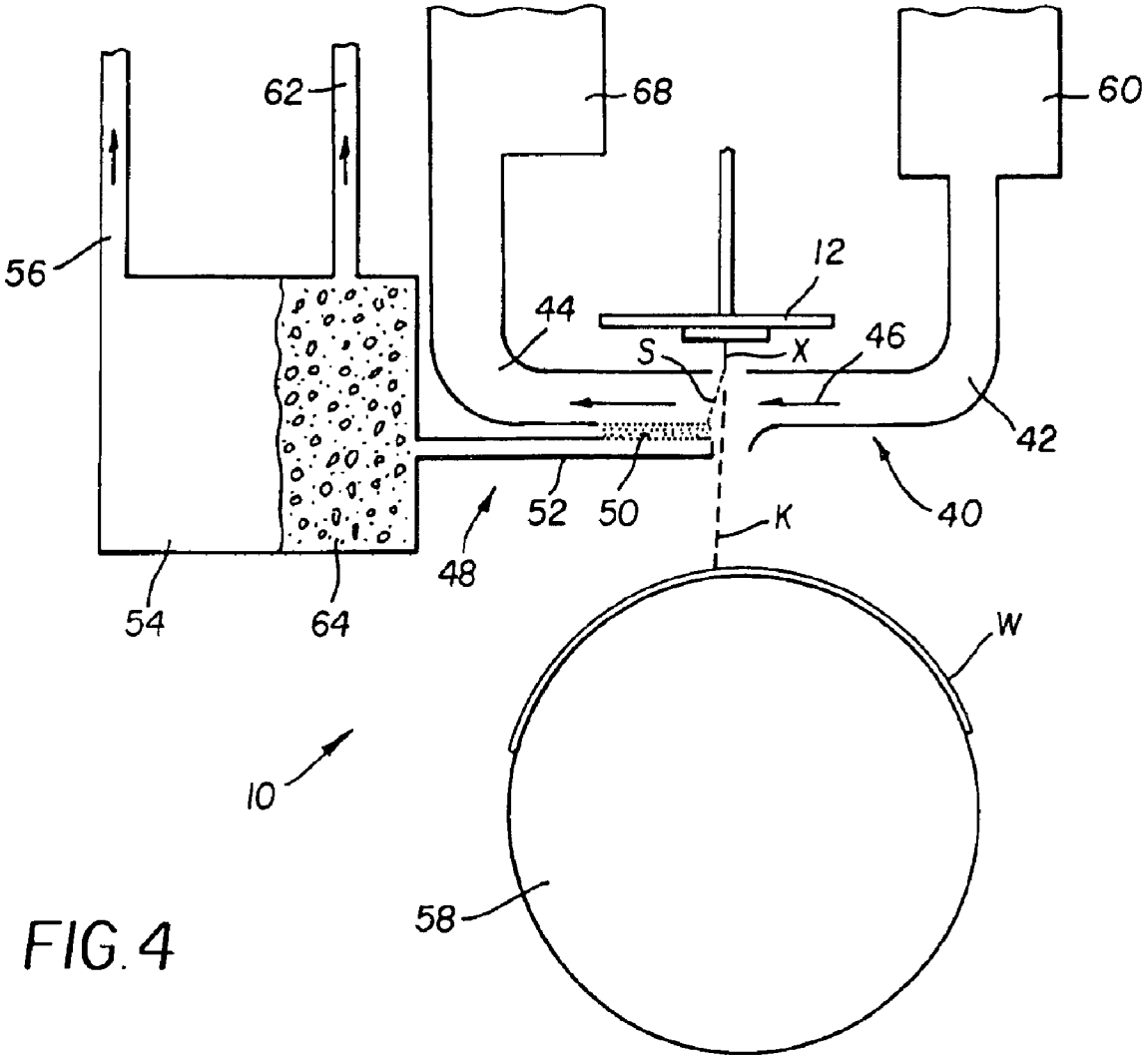
FIG. 4 is a schematic view of an ink jet printer made in accordance with a preferred embodiment of the present invention.

Referring to FIG. 4, a printing apparatus 10 is shown schematically. Large volume ink drops 28 and small volume ink drops 26 are formed from ink ejected from printhead 12 substantially along ejection path X in a stream. A droplet deflector 40 contains an upper plenum 42 and a lower plenum 44 which facilitate a laminar flow of gas in droplet deflector 40. Pressurized air from pump 60 enters upper plenum 42 which is disposed opposite lower plenum 44 and promotes laminar gas flow while protecting the droplet stream moving along path X from external air disturbances. Vacuum pump 68 communicates with lower plenum 44 and provides a sink for gas flow. In the center of droplet deflector 40 is positioned proximate path X. The application of force 46 due to gas flow separates the ink droplets into small-drop path S and large-drop path K.

An ink collection structure 48, disposed on one wall of lower plenum 44 near path X, intercepts the path of small volume droplets 26 moving along path S, while allowing large volume droplets 28 traveling along large droplet path K to continue on to the recording media W carried by print drum 58. Small volume droplets 26 strike porous element 50 in ink collection structure 48. Porous element 50 can be a wire screen, mesh, sintered stainless steel, or ceramic-like material. Small ink droplets 26 are drawn into the recesses in the porous material 50 by capillary forces and therefore do not form large ink drops on the surface of porous element 50. Ink recovery conduit 52 communicates with the back side of porous element 50 and operates at a reduced gas pressure relative to that in lower plenum 44. The pressure reduction in conduit 52 is sufficient to draw in recovered ink, however it is not large enough to cause significant air flow through porous element 50. In this manner of operation, foaming of the recovered ink is minimized. Ink recovery conduit 52 communicates also with recovery reservoir 54 to facilitate recovery of non-printed ink droplets by an ink return line 56 for subsequent reuse. Ink recovery reservoir 54 can contain an open-cell sponge or foam 64, which prevents ink sloshing in applications where the printhead 12 is rapidly scanned. A vacuum conduit 62, coupled to a negative pressure source can communicate with ink recovery reservoir 54 to create a negative pressure in ink recovery conduit 52 improving ink droplet separation and ink droplet removal as discussed above.

The gas pressure in droplet deflector 40 is adjusted in combination with the design of plenums 42, 44 so that the gas pressure in the print head assembly near ink guttering structure 48 is positive with respect to the ambient air pressure near print drum 58. Environmental dust and paper fibers are thusly discouraged from approaching and adhering to ink guttering structure 48 and are additionally excluded from entering lower plenum 44.

In operation, a recording media W is transported in a direction transverse to axis x by print drum 58 in a known manner. Transport of recording media W is coordinated with movement of printing apparatus 10 and/or movement of printhead 12. This can be accomplished using controller 16 in a known manner. Recording media W may be selected from a wide variety of materials including paper, vinyl, cloth, other fibrous materials, etc.

Figure 5:
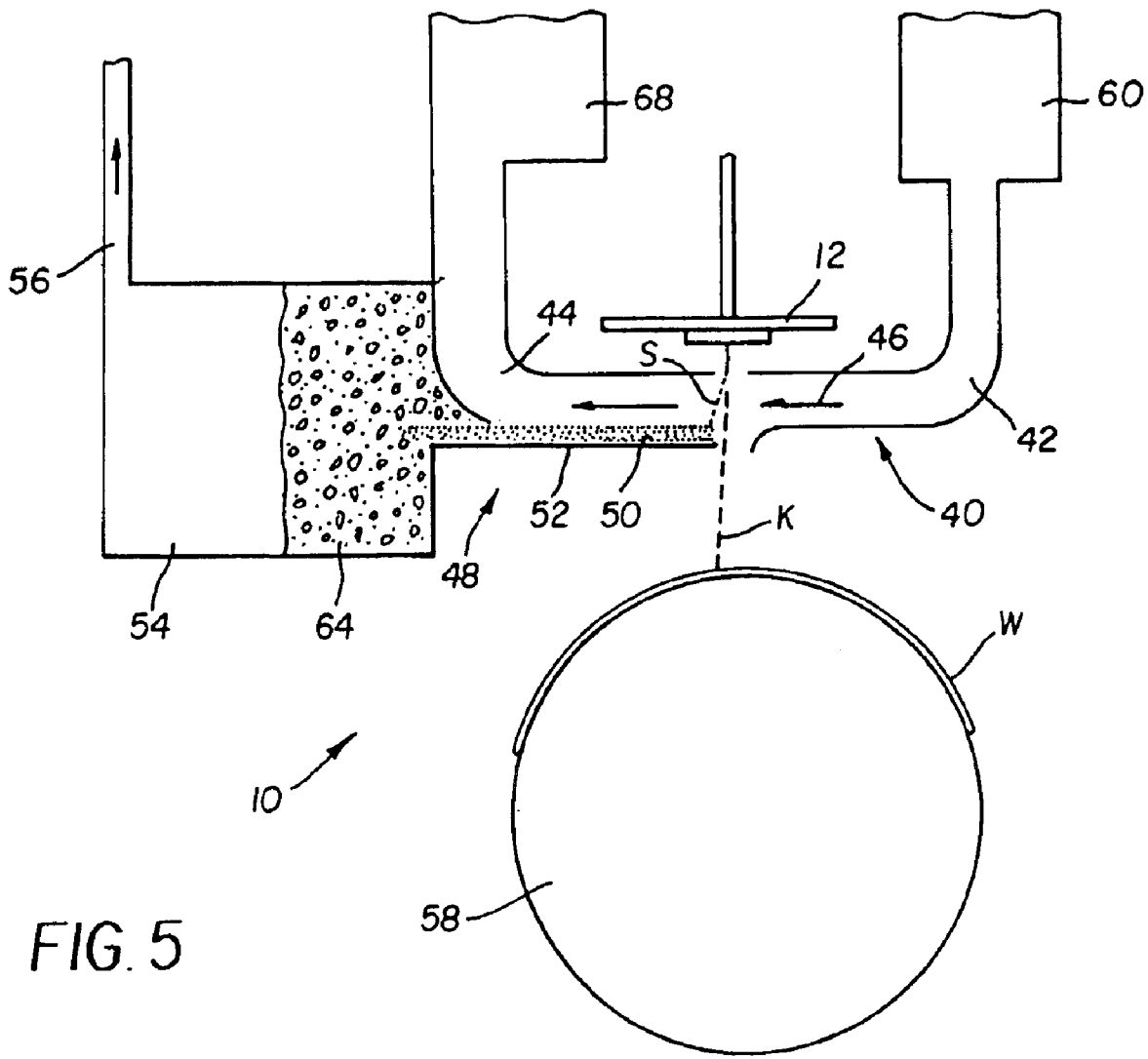
FIG. 5 is a schematic view of an ink jet printer made in accordance with another embodiment of the present invention.

Referring to FIG. 5, an alternative embodiment of the present invention is shown with like elements being described using like reference signs. Large volume ink drops 28 and small volume ink drops 26 are formed from ink ejected from printhead 12 substantially along ejection path X in a stream. A droplet deflector 40 contains upper plenum 42 and lower plenum 44 which facilitate a laminar flow of gas in droplet deflector 40. Pressurized air from pump 60 enters upper plenum 42 which is disposed opposite lower plenum 44 and promotes laminar gas flow while protecting the droplet stream moving along path X from external air disturbances. Vacuum pump 68 communicates with lower plenum 44 and provides a sink for gas flow. In the center of droplet deflector 40 is positioned proximate path X. The application of force 46 due to gas flow separates the ink droplets into small-drop path S and large-drop path K.

An ink collection structure 48, disposed on one wall of lower plenum 44 near path X, intercepts the path of small volume droplets 26 moving along path S, while allowing large volume droplets 28 traveling along large droplet path K to continue on to the recording media W carried by print drum 58. Small volume droplets 26 strike porous element 50 in ink collection structure 48. Porous element 50 can be a wire screen, mesh, sintered stainless steel, or ceramic-like material. Small ink droplets 26 are drawn into the recesses in the material by capillary forces and therefore do not form large ink drops on the surface of porous element 50. Gravity causes a uniform flow of ink captured by porous element 50 to move downward, largely through the interior of porous element 50, and enter into ink recovery reservoir 54. Ink is then removed from reservoir 54 through line 56 for reuse.

Alternatively, large droplets 28, travelling along path K can be collected by porous element 50 by repositioning porous element 50 to capture drops travelling along path K while allowing drops travelling along path S to strike print media W. Creating a negative gas flow 46 that travels in a direction opposite the direction of force 46 shown in FIGS. 4 and 5 would also facilitate the capturing of drops travelling along path K without having to significantly reposition porous element 50. This is because reversing the flow of force 46 causes path S to form at substantially the same angle of deflection in an opposite direction.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An apparatus for printing an image comprising:

an ink droplet forming mechanism operable to selectively create a stream of ink droplets having a plurality of volumes traveling along a first path; and a droplet deflector positioned at an angle with respect to the stream of ink droplets, the droplet deflector including a gas flow operable to interact with the stream of ink droplets such that ink droplets having one of the plurality of volumes begin traveling along a second path and ink droplets having another of the plurality of volumes begin traveling along a third path; and a catcher, at least a portion of the catcher including a porous material, the porous material being at least partially positioned in one of the first, second, and third paths.

2. The apparatus according to claim 1, wherein the porous material is a mesh.

3. The apparatus according to claim 1, wherein the porous material is a ceramic.

4. The apparatus according to claim 1, wherein the porous material is a metal.

5. The apparatus according to claim 1, further comprising an ink recovery conduit in fluid communication with the porous material, the ink recovery conduit having a gas pressure such that ink flows from the porous material to the ink recovery conduit.

6. The apparatus according to claim 1, wherein the droplet forming mechanism includes a beater positioned proximate to the stream of ink droplets.

7. The apparatus according to claim 6, wherein the heater is operable to be selectively actuated at a plurality of frequencies such that the stream of ink droplets having the plurality of volumes is created.

8. The apparatus according to claim 1, wherein the gas flow is a positive pressure flow.

9. The apparatus according to claim 8, wherein the gas flow is positioned substantially perpendicular to said stream of ink droplets.

10. A method of manufacturing an inkjet printhead comprising:

providing an ink droplet forming mechanism operable to selectively create a stream of ink droplets having a plurality of volume traveling along a first path;

providing a droplet deflector positioned at an angle with respect to the stream of ink droplets, the droplet deflector including a gas flow operable to interact with the stream of ink droplets such that ink droplets having one of the plurality of volumes begin traveling along a second path and ink droplets having another of the plurality of volumes begin traveling along a third path; and providing a catcher, at least a portion of the catcher including a porous material, the porous material being at least partially positioned in one of the first, second, and third paths.

11. The method according to claim 10, further comprising providing an ink recovery conduit in fluid communication with the porous material, the ink recovery conduit having a gas pressure such that ink flows from the porous material to the ink recovery conduit.

12. The method according to claim 10, wherein providing the droplet forming mechanism includes providing a droplet forming mechanism having a nozzle and a heater positioned proximate to the nozzle.

13. The method according to claim 12, further comprising positioning the gas flow substantially perpendicular to nozzle.

14. The method according to claim 10, wherein the gas flow is a positive pressure flow.

15. An apparatus for printing an image comprising:

a droplet forming mechanism operable in a first state to form droplets having a first volume travelling along a path and in a second state to form droplets having a second volume travelling along the path; and a system which applies force to the droplets travelling along the path, the force being applied in a direction such as to separate droplets having the first volume from droplets having the second volume, a portion of the system being made from a porous material, the porous material being positioned to catch one of the droplets having the first volume and the droplets having the second volume.

16. The apparatus according to claim 15, wherein the force is a positive pressure gas flow.

17. The apparatus according to claim 15, wherein the force is applied in a direction substantially perpendicular to the path.

18. The apparatus according to claim 15, wherein the force is a negative pressure gas flow.

19. The apparatus according to claim 15, wherein the porous material a ceramic material.

20. The apparatus according to claim 15, wherein the droplet forming mechanism includes a heater; and a controller electrically coupled to the heater, the controller being configured to activate the heater at a plurality of frequencies such that the droplets having the first volume and the droplets having the second volume are formed.

21. An apparatus for printing an image comprising:

an ink droplet forming mechanism operable to selectively create a stream of ink droplets having a plurality of volumes traveling along a first path; and a droplet deflector positioned at an angle with respect to the stream of ink droplets, the droplet deflector including a gas flow operable to interact with the stream of ink droplets such that ink droplets having one of the plurality of volumes begin traveling along a second path and ink droplets having another of the plurality of volumes begin traveling along a third path; and a catcher, at least a portion of the catcher including a porous material at least partially positioned in one of the first, second, and third paths, wherein the porous material is a ceramic.

22. An apparatus for printing an image comprising:

an ink droplet forming mechanism operable to selectively create a stream of ink droplets having a plurality of volumes traveling along a first path; and a droplet deflector positioned at an angle with respect to the stream of ink droplets, the droplet deflector including a gas flow operable to interact with the stream of ink droplets such that ink droplets having one of the plurality of volumes begin traveling along a second path and ink droplets having another of the plurality of volumes begin traveling along a third path; and a catcher, at least a portion of the catcher including a porous material at least partially positioned in one of the first, second, and third paths, wherein the porous material is a metal.

23. An apparatus for printing an image comprising:

a droplet forming mechanism operable in a first state to form droplets having a first volume travelling along a path and in a second state to form droplets having a second volume travelling along the path; and a system which applies force to the droplets travelling along the path, the force being applied in a direction such as to separate droplets having the first volume from droplets having the second volume, a portion of the system being made from a porous material positioned to catch one of the droplets having the first volume and the droplets having the second volume, wherein the porous material a ceramic material.

* * * * *